US005791937A

United States Patent [19]

Kitajima et al.

[11] Patent Number: 5,791,937

[45] Date of Patent: Aug. 11, 1998

[54] CONNECTION APPARATUS FOR CATV REPEATER

[75] Inventors: Yasuhiro Kitajima; Kouichi Kawada, both of Tokyo, Japan

[73] Assignee: NEC Corporation, Tokyo, Japan

[21] Appl. No.: 656,690

[22] Filed: May 31, 1996

[30] Foreign Application Priority Data

Jun. 27, 1995 [JP] Japan ..... 7-160451

[51] Int. Cl.[6] ..... H01R 17/18

[52] U.S. Cl. ..... 439/578; 439/812

[58] Field of Search ..... 439/578, 801, 439/810–812, 814

[56] References Cited

U.S. PATENT DOCUMENTS

| | | | |
|---|---|---|---|
| 2,754,487 | 7/1956 | Carr et al. | 439/578 |
| 3,125,397 | 3/1964 | McGrath | 439/811 |
| 4,256,935 | 3/1981 | Ito et al. | 439/578 |
| 4,892,491 | 1/1990 | Budano, II et al. | 439/578 |
| 5,108,320 | 4/1992 | Kimber | 439/801 |

*Primary Examiner*—J. J. Swann

*Attorney, Agent, or Firm*—Young & Thompson

[57] ABSTRACT

The invention realizes a CATV repeater which has a reduced distance from a coaxial connector of a coaxial cable to a receptacle on a printed circuit board of an amplifier to prevent deterioration of the high frequency characteristic and besides facilitates connection and is tough against an outdoor environment. Receptacle 32 of amplification device 30 can be inserted into guide metal member 11 of body case 10, and the core of receptacle 32 is connected to core 21 of coaxial connector 20 of a coaxial cable by L-shaped connection pin 13. L-shaped connection pin 13 includes connection pin **13*b* having, at an end thereof, a cylindrical pin to be fitted with the receptacle of the amplifier and having, at the other end thereof, a U-shaped portion, and connection pin 13*a* having, at an end portion thereof, a hollow cylindrical portion with a pair of slits on the coaxial cable side and having, at the other end portion thereof, a cylindrical connection portion with ring-shaped projections with which the positioning of the U-shaped portion of connection pin 13*b*** is set in a limited position.

5 Claims, 3 Drawing Sheets

CONNECTION APPARATUS FOR CATV REPEATER

BACKGROUND OF THE INVENTION

1. Field of the Invention

This invention relates to a connection structure for a CATV repeater, and more particularly to a structure for connecting a coaxial cable connector of an amplifier removably mounted on a body case of a repeater and a coaxial cable connector provided on the body case for connecting a coaxial cable.

2. Description of the Related Arts

In order to transmit a TV signal from a CATV station to remote subscribers, CATV repeaters are connected in series. When some failure occurs with some intermediate repeater, a signal is not transmitted to those repeater following the failed repeater, causing many subscribers trouble. One of the possible reasons of failure is a connection between a CATV repeater and a coaxial cable. Particularly since CATV repeaters are installed in the open air and subject to a very wide range of temperature variation by sunshine, rain, snow and so forth, a crack is tend to be produced at a soldered connection portion, resulting in failure in the connection.

FIGS. 1 and 2 show an example of a conventional connection structure which does not employ soldering.

As shown in FIG. 1, a case of a CATV repeater is composed of body case 40 and an openable lid (not shown). Amplifier 30 for amplifying a TV signal is removably mounted on body case 40. Amplifier 30 includes printed circuit board 31 on which an amplifier circuit is printed, and metal case 33 for allowing heat generated by the amplifier circuit to diffuse to body case 40. In order to facilitate mounting and removal of amplifier 30, receptacle 32 for a signal is provided on printed circuit board 31.

Meanwhile, body case 40 includes coaxial connector 20 to which a coaxial cable is connected, guide metal member 41 into which receptacle 32 of printed circuit board 31 is inserted, orthogonal connection member 42, L-shaped connection pin 43 located in the inside of orthogonal connection member 42 for transmitting a signal from core 21 of the coaxial cable in an orthogonal direction to receptacle 32, pressure contacting screw 44 for pressing core 21 to L-shaped connection pin 43, and grounding plate 45 for grounding guide metal member 41.

Core 21 is pressure contacted to L-shaped connection pin 43 to connect each other by pressure contacting screw 44 as shown in FIG. 2 and connected to the amplifier circuit via receptacle 32 provided on printed circuit board 31.

As described above, in the conventional connection structure for a CATV repeater, the core of a coaxial cable and an L-shaped connection pin are pressure contacted with and connected to each other by tightening a pressure contacting screw without soldering. However, a space in which the pressure contacting screw is disposed is required and the L-shaped connection pin must have as much additional length. Therefore, the conventional connection structure for a CATV repeater is disadvantageous in that the frequency characteristic of a signal is deteriorated by the L-shaped connection pin of the additional length.

SUMMARY OF THE INVENTION

It is an object of the present invention to provide a connection method and apparatus for a CATV repeater by which a CATV can be connected without using soldering or a pressure contacting screw and the distance from the core of a coaxial cable to a receptacle of a printed circuit board can be reduced to prevent deterioration of the high frequency characteristic.

It is another object of the present invention to provide a disclosure of a coaxial cable connection method for a CATV repeater in which a core of a first coaxial connector provided in a body case of the CATV repeater for connecting a coaxial connector and a second coaxial connector provided for an amplifier removably mounted in the body case to each other by an L-shaped connection pin, comprising the steps of:

setting the L-shaped connection pin connecting a first connecting pin having a hollow cylindrical connection socket end and a second connecting pin having a thin rod type core end portion orthogonally at their opposite end portions;

inserting the core of the coaxial connector of coaxial cable removable so tight as to have no electric resistance into said hollow cylindrical connection socket end of the L-shaped connection pin; and thrusting a socket of the coaxial connector of the amplifier onto the rod type core end of the L-shaped connection pin so tight as to have no electric resistance.

It is a still another object of the present invention to provide a disclosure of a coaxial cable connection device for a CATV repeater in which a core of a first coaxial connector provided in a body case of the CATV repeater for connection of a coaxial cable and a second coaxial connector provided for an amplifier removably mounted in the body case are connected to each other by an L-shaped connection pin, comprising: one end of the L-shaped connection socket corresponding to the first coaxial connector is formed as a metallic hollow cylinder having at least a pair of slits formed therein so as to provide resiliency to the hollow cylinder, and the core is resiliently inserted into the hollow cylinder; and the other end of said L-shaped connection pin corresponding to the second coaxial connector is formed as a rod type core on which a socket of the second coaxial connector is inserted.

Preferably, the connection apparatus for a CATV repeater of the present invention is constructed such that the L-shaped pin includes a first connection pin having the socket with which said core of said first coaxial connector of the coaxial cable is fitted and a second connection pin with which said coaxial connector provided on the amplifier is fitted, the first and second connection pins being connected orthogonally to each other by contact joining, and the contact joining end portion of the second connection pin at which the second connection pin is joined to the first connection pin has a U-shaped profile while the contact joining end portion of the first connection pin has a cylindrical profile with which an opening of the U-shaped profile is fitted and the first connection pin has a pair of fixing portions on the cylindrical profile portion with which the end portion of the second connection pin having the U-shaped profile is set into limited position.

Further, it is also preferable that a connection apparatus for a CATV repeater of the present invention provides the each of the fixing portions as a ring-like projection and the fixing portions are set so that the end portion of the second connection pin having the U-shaped profile is positioned having margin of deflection for positioning within a predetermined range.

Other and further objects of this invention will become obvious upon understanding the illustrative embodiments described or indicated in the appended claims, and various advantages not referred to herein will occur to one skilled in the art upon employment of the invention in practice.

DESCRIPTION OF THE PREFERRED EMBODIMENT

The present invention is described below with reference to the drawings.

Figure 1:
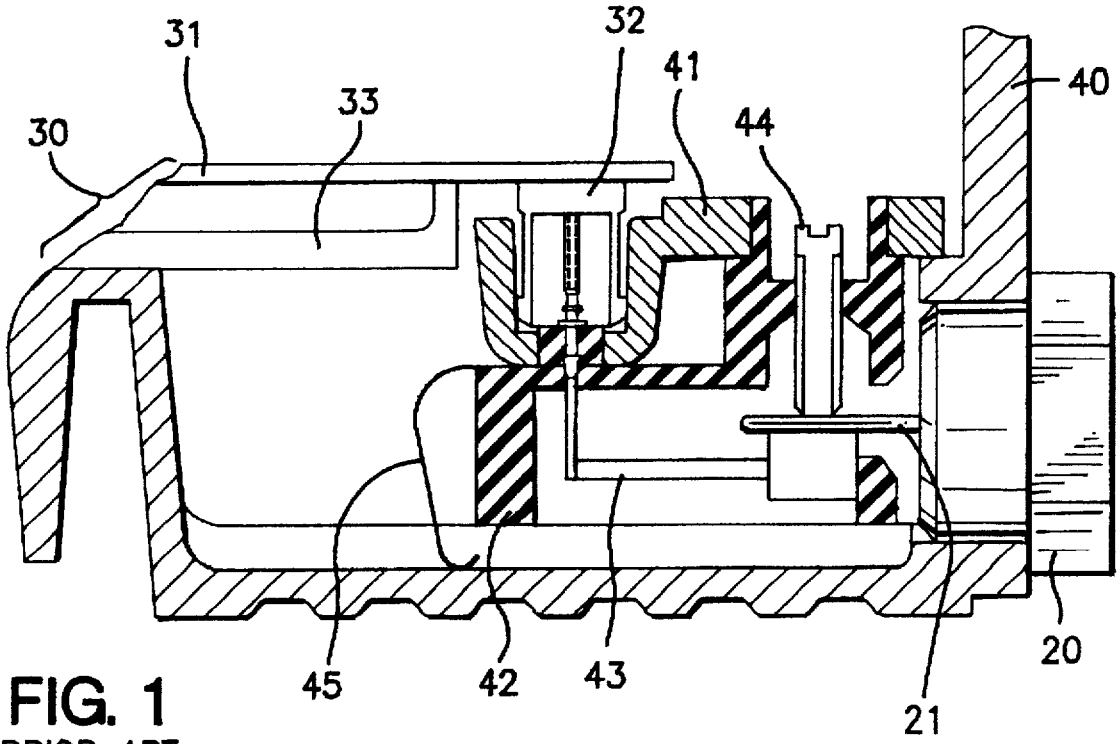
FIG. 1 PRIOR ART
FIG. 1 is a sectional view showing a connection portion of a coaxial cable of a conventional CATV repeater.
Figure 3:
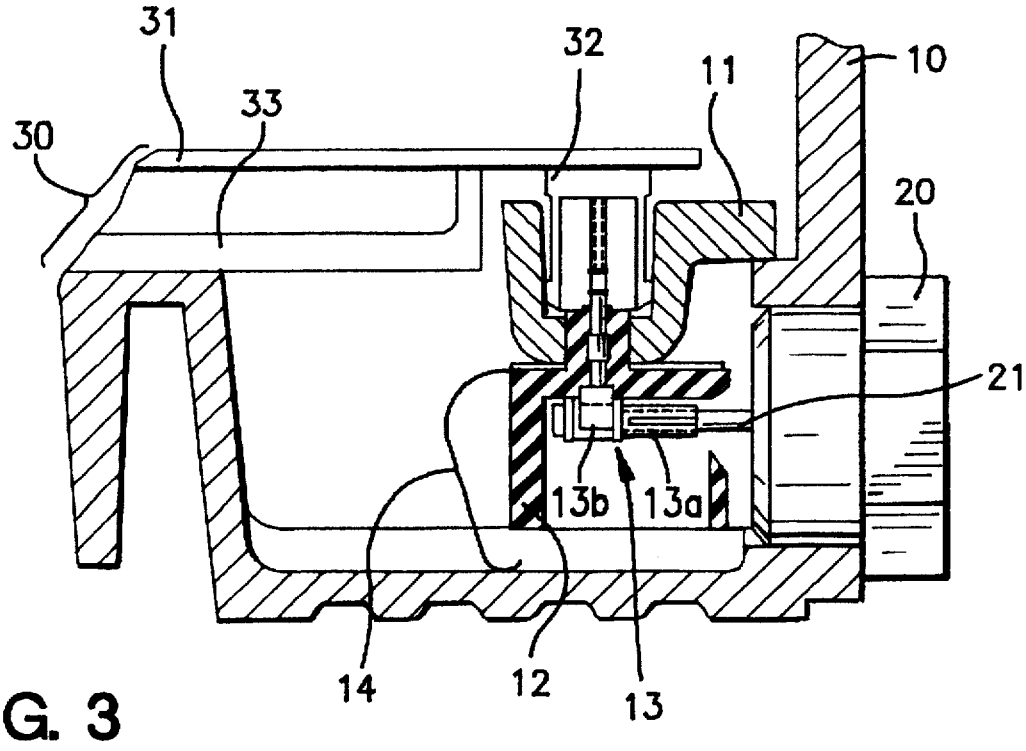
FIG. 3 is a sectional view of an embodiment of a connection apparatus for a CATV repeater of the present invention.
Figure 2:
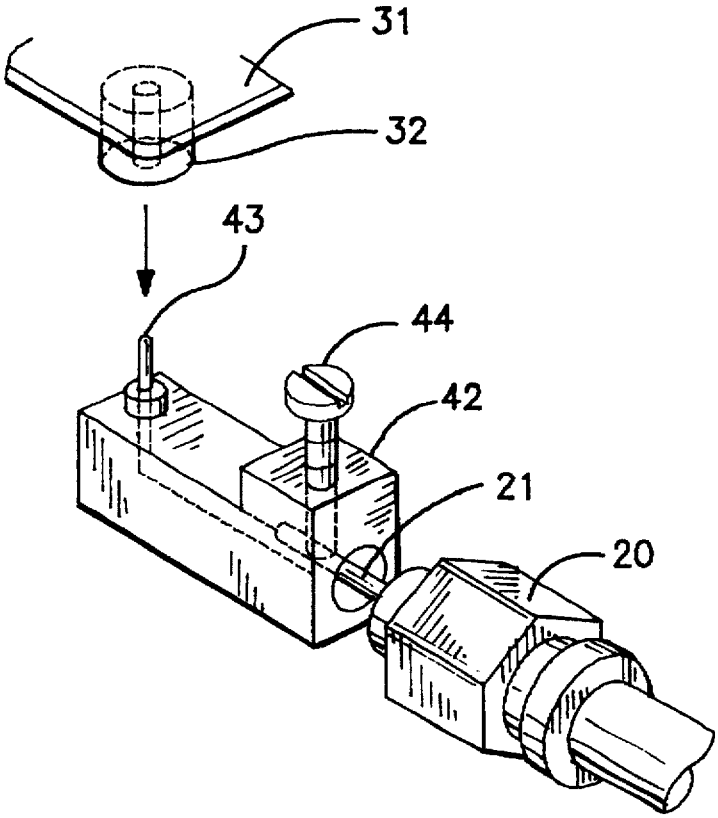
FIG. 2 PRIOR ART
FIG. 2 is a perspective view illustrating a conventional connection of a coaxial connector.
Figure 4:
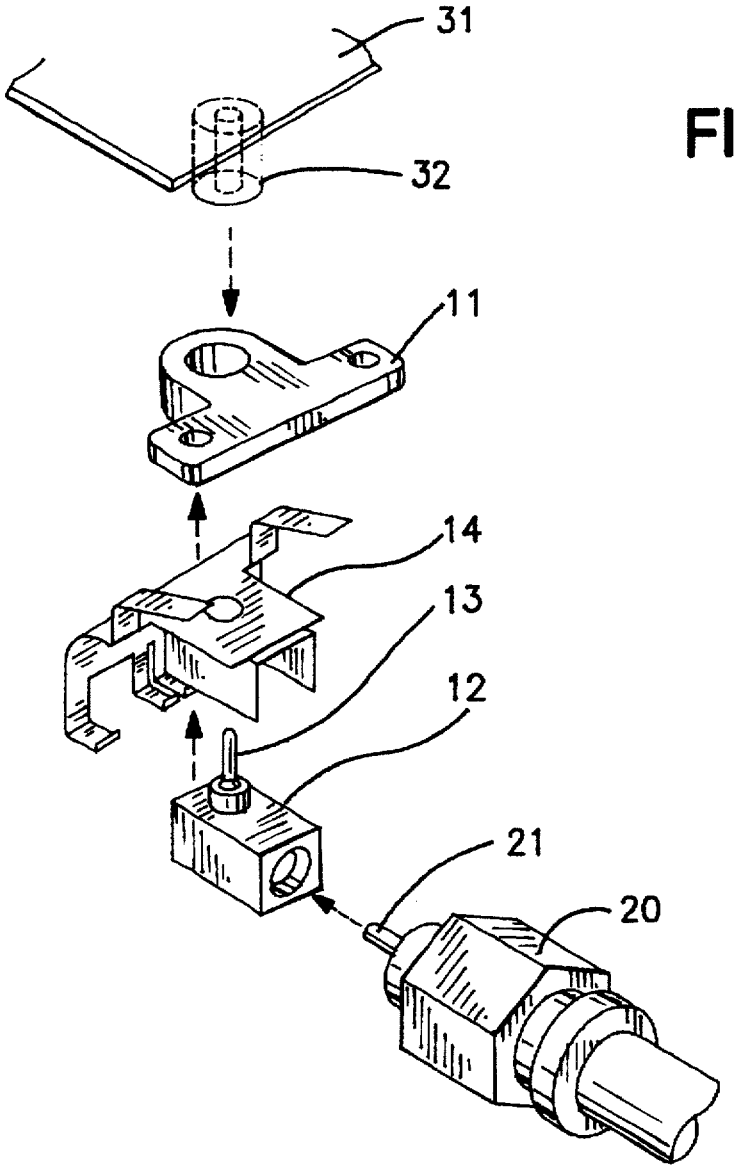
FIG. 4 is an exploded view of a coaxial connector in the embodiment of the connection apparatus for a CATV repeater of the present invention.

FIG. 3 is a sectional view of a principal part of an embodiment of a connection apparatus for a CATV repeater of the present invention. It is to be noted that the same components as those of the conventional example shown in FIG. 1 are denoted by the same reference numerals.

Amplification device 30 mounted on body case 10 of a CATV repeater includes printed circuit board 31 on which an amplifier circuit is arranged, and metal case 33 for allowing heat generated by the amplifier circuit to diffuse to the body case.

Figure 5:
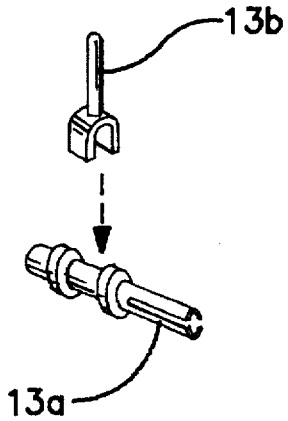
FIG. 5 is a perspective view of a dismantled L-shaped pin in the embodiment of the connection apparatus for a CATV repeater of the present invention.

Body case 10 includes coaxial connector 20 to which a coaxial cable is connected, guide metal member 11 into which receptacle 32 of printed circuit board 31 is inserted, L-shaped connection pin 13 provided in the inside of orthogonal connection member 12 for connection between core 21 of the coaxial cable and receptacle 32, and grounding plate 14 on which guide metal member 11 is connected. Core 21 of the coaxial cable is connected to receptacle 32 of printed circuit board 31 via L-shaped connection pin 13. L-shaped connection pin 13 is formed from two connection pins **13*a* and 13*b* joined to each other as shown in FIG. 5. Connection pin 13*a* is in the form of a metal bar of a circular cross section and has an end portion formed as a hollow cylinder having a slit in an axial direction thereof. Core 21 is inserted into and closely contacted with the hollow cylinder of connection pin 13*a*. Connection pin 13*a* further has a pair of ring-like projections formed at the other end portion thereof in order to define a joining position for connection pin 13*b***.

Connection pin **13*b* has, at an end thereof, a portion for being fitted in receptacle 32 of printed circuit board 31 and has, at the other end thereof, a U-shaped portion. The U-shaped portion can be fitted into contact between the two ring-like projections of connection pin 13*a* to mount connection pin 13*b* in an orthogonal direction onto connection pin 13*a*** readily.

Where the distance between the ring-like projections of connection pin **13*a* is set larger than the width of the U-shaped portion of connection pin 13*b*, the position of connection pin 13*b* can be adjusted upon joining of connection pin 13*b* to connection pin 13*a*. Consequently, relative positioning between connection pins 13*a* and 13*b*** can be performed readily.

Where L-shaped connection pin 13 is formed from connection pins **13*a* and 13*b*** in this manner, the length of the L-shaped connection pin can be reduced comparing with that of the conventional connection apparatus which employs a pressure contacting pin.

As described above, according to the present invention, since one end of an L-shaped connection pin is formed as a hollow cylinder having a slit formed therein and a core of a coaxial cable is inserted into the hollow cylinder to connect the coaxial cable, such a pressure contacting screw as is required for a conventional connection apparatus need not be used, and accordingly, the distance from the core of the coaxial cable to the receptacle of the printed circuit board can be reduced. Consequently, not only deterioration of the high frequency characteristic can be prevented, but also reduction in size of the apparatus or room of the mounting space in the apparatus can be anticipated.

Further, where the L-shaped connection pin includes a connection pin having a U-shaped portion and another connection pin having a pair of ring-shaped projections for defining a joining location for the U-shaped portion, an assembling method of an L-shaped connection pin is facilitated and the productivity is improved, which allows reduction of the cost.

What is claimed is:

1. A coaxial cable connection apparatus having a first receptacle in a body case of a CATV repeater for connection of a lead-in coaxial cable and a second receptacle for an amplifier removably mounted in the body case, the first and second receptacles being connected through an L-shaped connection pin, the L-shaped connection pin comprising:

a connection socket for receiving a core pin of the lead-in coaxial cable, said socket comprising a metallic hollow cylinder having at least a pair of slits therein so as to provide resiliency to the hollow cylinder and a cylindrical connection end spaced from said pair of slits, said connection end having pair of spaced apart fixing portions; and a connection pin having a U-shaped connection end that is slidably connected orthogonally onto said cylindrical connection end of said connection socket between said fixing portions, and having a round rod at its other end for insertion into a core socket of the second receptacle;

said fixing portions being spaced apart a distance larger than a width of said U-shaped connection end so that said U-shaped connection end is laterally slidable on said cylindrical connection end between said fixing portions to change a position of said connection pin relative to said connection socket without breaking a connection therebetween.

2. The connection apparatus for a CATV repeater as set forth in claim 1, wherein each of said fixing portions is a ring-like projection.

3. The connection apparatus for a CATV repeater as set forth in claim 1, wherein said U-shaped connection end comprises a semicircularly folded metal ribbon with the ribbon surface width being greater than a thickness thereof, an interior surface of the width of said folded metal ribbon being in pressural contact with an exterior surface of said cylindrical connection end.

4. A coaxial cable connection apparatus comprising:

a cylindrical connection socket for receiving a core pin of a coaxial cable, said socket comprising an opening at one end for receiving the core pin and a pair of radially extended and spaced apart stops on an exterior surface thereof; and a connection pin having a U-shaped connection end that is connected to and laterally slidable on the exterior surface of said cylindrical connection socket between said stops, and having a round rod at its other end for insertion into a core socket, said stops being spaced apart a distance larger than a width of said U-shaped connection end so that said U-shaped connection end is laterally slidable on said cylindrical connection socket between said stops to change a position of said connection pin relative to said connection socket without breaking a connection therebetween.

5. The connector of claim 4, wherein said U-shaped connection end is a folded metal ribbon with a surface width greater than a thickness thereof, and wherein an interior surface of the width of said ribbon is in pressural contact with an exterior surface of said cylindrical connection socket.

* * * * *